US005704708A

United States Patent [19]

Barson et al.

[11] Patent Number: 5,704,708

[45] Date of Patent: Jan. 6, 1998

[54] LOUVERED LAMP ASSEMBLY WITH THERE BOSS MOUNTING SYSTEM

[75] Inventors: Robert Dee Barson, Hyde Park; Derik Remmelle West, Logan, both of Utah

[73] Assignee: Integrated Systems Engineering, Inc., Logan, Utah

[21] Appl. No.: 630,526

[22] Filed: Apr. 10, 1996

[51] Int. Cl.[6] ..... F21V 29/00; F21V 1/00

[52] U.S. Cl. ..... 362/238; 362/240; 362/362; 362/367

[58] Field of Search ..... 362/18, 66, 238, 362/240, 257, 272, 311, 351, 367, 373, 374, 433, 362

[56] References Cited

U.S. PATENT DOCUMENTS

| | | | |
|---|---|---|---|
| 2,417,443 | 3/1947 | Paul | 362/374 |
| 2,852,758 | 9/1958 | Beaubien et al. | 362/374 |
| 3,270,192 | 8/1966 | Watson | 362/433 |
| 3,398,270 | 8/1968 | De Vos et al. | 362/257 |
| 4,234,914 | 11/1980 | Boesen | 362/240 |
| 4,254,453 | 3/1981 | Mouyard et al. | 362/238 |
| 4,310,875 | 1/1982 | Price | 362/277 |
| 5,034,866 | 7/1991 | Pujol | 362/373 |
| 5,091,835 | 2/1992 | Malek et al. | 362/373 |
| 5,161,876 | 11/1992 | Smith | 362/66 |
| 5,278,745 | 1/1994 | Kelly et al. | 362/311 |
| 5,321,417 | 6/1994 | Voelzke et al. | 362/240 |

*Primary Examiner*—Ira S. Lazarus
*Assistant Examiner*—Matthew Spark
*Attorney, Agent, or Firm*—Kane, Dalsimer, Sullivan, Kurucz, Levy, Eisele and Richard, LLP

[57] ABSTRACT

The apparatus is a lamp assembly with a plurality of bulb assemblies used for data (or similar) display with varying character sizes. The bulb assemblies include a reflector with three bosses. Two of the bosses snap detent engage a lampbank while the third boss extends through the lampbank, attaches to a printed circuit board and serves as a standoff or spacer therefrom. The bulb assemblies further include a louver which snap engages onto the lens to form a lens/louver assembly which hinges and snaps to the reflector. The louver can be used as a handle to remove the lens from the bulb assembly.

7 Claims, 3 Drawing Sheets

LOUVERED LAMP ASSEMBLY WITH THERE BOSS MOUNTING SYSTEM

BACKGROUND OF THE INVENTION

1. Field of the Invention

This invention pertains to a lamp assembly used for data display which includes bulb assemblies with a louver which snaps onto the lens thereby providing a handle for the removal of the louver/lens assembly. Additionally, the bulb assemblies are held in place by a mounting system which includes two bosses which snap into the lampbank and a third boss which passes through the lampbank, attaches to the printed circuit board and serves as a standoff or spacer from the printed circuit board.

2. Description of the Prior Art

In the prior art, typical lamp assemblies used for data display have included elements, such as lenses, which have been difficult to remove in order to gain access to the bulb. Additionally, typical prior art lamp assemblies used for data display have been difficult to reconfigure to produce different character heights.

OBJECTS AND SUMMARY OF THE INVENTION

It is therefore an object of this invention to provide a lamp assembly for data display which provides simple removal of elements of the individual lamp or bulb assembly in order to provide access to the bulb of the lamp assembly.

It is therefore a further object of this invention to provide a lamp assembly for data display which can be easily reconfigured to produce different character heights.

These and other objects are attained by providing a lamp assembly for data display with an array of bulb assemblies in electrical and mechanical communication with a printed circuit board. Each bulb assembly includes a bulb, a reflector cup, a lens and a sun louver. The sun louver, which is used to shield the display from the sun or ambient light thereby increasing the contrast of the display, snaps to the lens and serves as a handle to allow the simple removal of the lens/louver assembly thereby providing easy access to the bulb.

The reflector cup includes three bosses—two snap bosses which hold the reflector cup to the lampbank and a third boss which passes through the lampbank, attaches to the printed circuit board and serves as a standoff or spacer from the printed circuit board.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
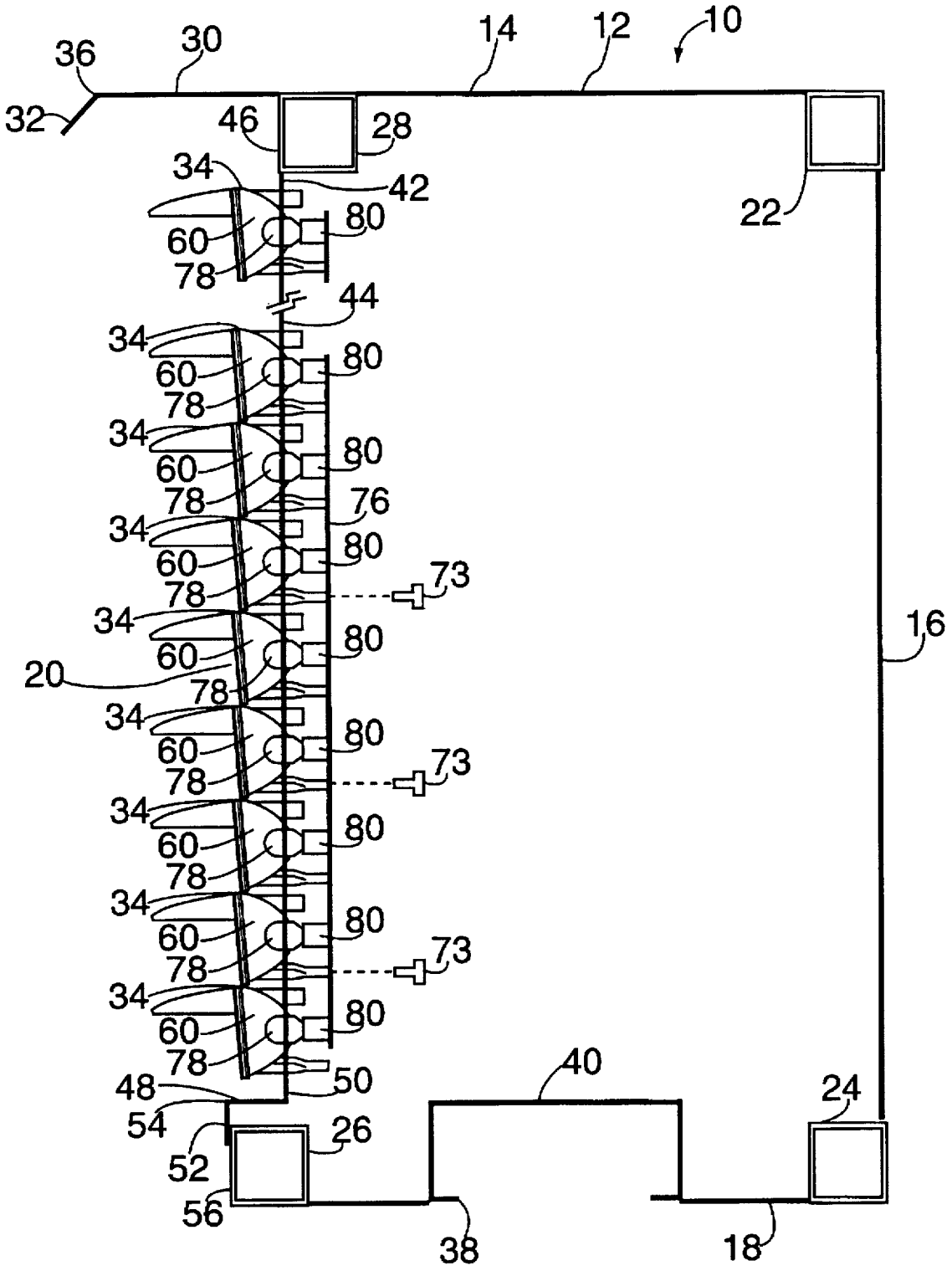
FIG. 1 is a side view, partially in cross section, of the lamp assembly of the present invention.

Referring now to the drawings in detail wherein like numerals refer to like elements throughout the several views, one sees that FIG. 1 is a side view, partially in cross section, of the lamp assembly 10. Lamp assembly 10 comprises a cabinet or housing 12 of approximately rectangular cross section and parallelpiped shape. As shown in FIG. 1, the rectangular cross section is formed by upper face 14, rear face 16, bottom face 18 and front face 20. Alternately, front face 20 can be implemented as a fixed front face. Horizontal structural members 22, 24, 26, 28, shown in cross section as rectangular, provide the structural support at the intersections of the faces identified above. Horizontal structural member 26 is somewhat outwardly horizontal from horizontal structural member 28. Additionally, congruent with upper face 14 and extending over front face 20 is horizontal rain guard 30 with a downwardly sloping rain drip lip 32 at a distal end 36 thereof. Horizontal rain guard 30 and downwardly sloping drain drip lip 32 serve to protect front face 20 and the array of bulb assemblies 34 thereon from precipitation and further serve to shield the front face 20 and the array of bulb assemblies 34 from sunlight thereby increasing the contrast of the image displayed therefrom.

Bottom face 18 includes centrally located aperture 38 to provide communication from the atmosphere to fan 40 in order to cool bulb assemblies 34 and the interior of cabinet or housing 12.

Front face 20 comprises lampbank 42 which further includes main vertical portion 44 extending downwardly from outer vertical surface 46 of horizontal support structure 28, horizontal portion 48 which extends horizontally outward from a lower end 50 of main vertical portion 44, and lower vertical portion 52 which extends from outer end 54 of horizontal portion 48 to outer vertical surface 56 of horizontal structural member 26. Lampbank 42 serves as a structural portion of cabinet or housing 12 and further provides the support for the array of bulb assemblies 34.

Figure 2:
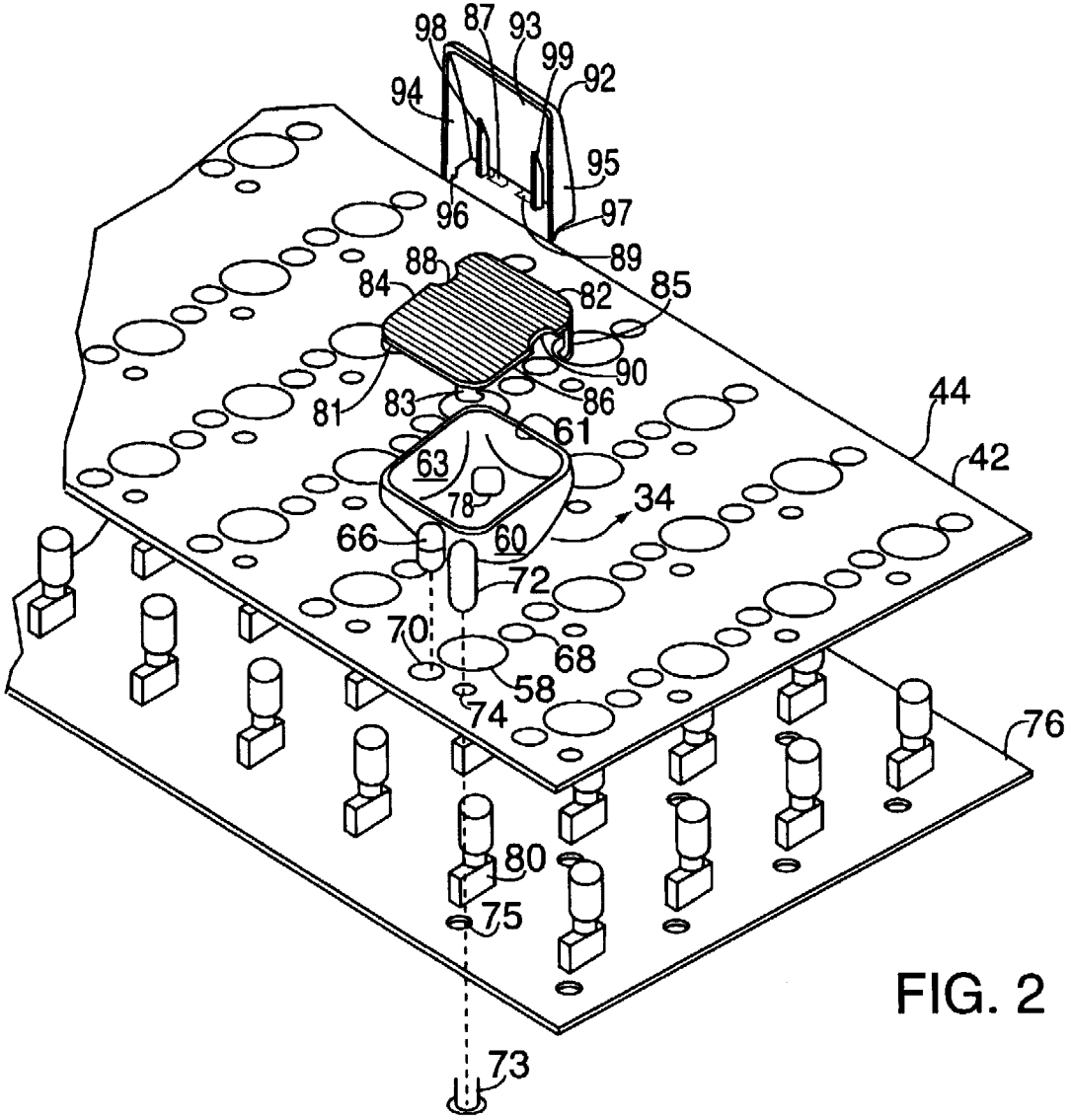
FIG. 2 is a front exploded perspective view of the lamp assembly of the present invention, showing the attachment of the various elements of the bulb assembly.
Figure 3A:
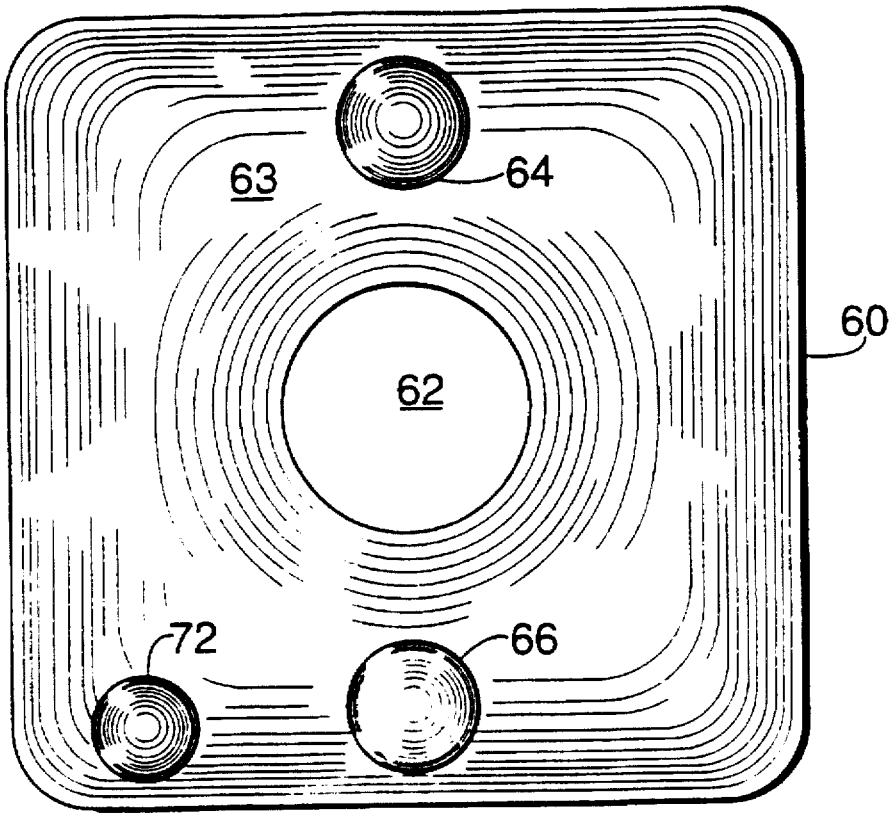
FIG. 3A is a rear plan view of the reflector cup of the present invention.
Figure 3B:
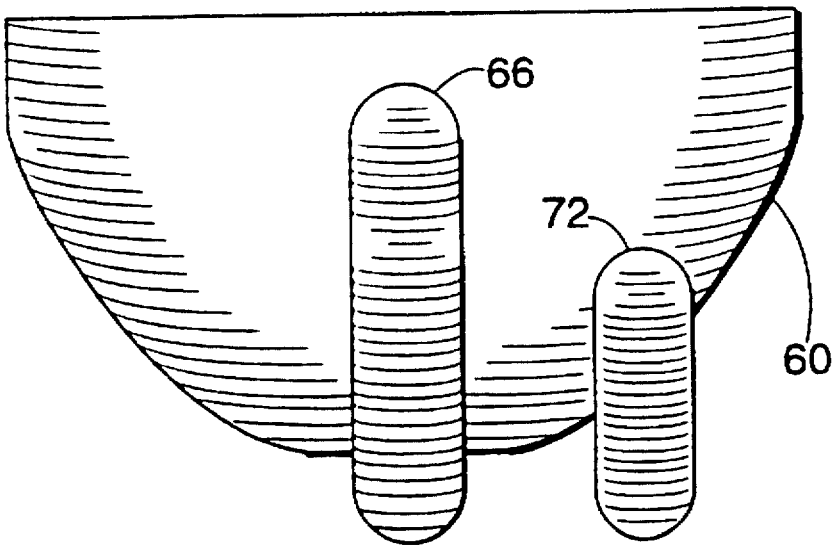
FIG. 3B is a side plan view of the reflector cup of the present invention.

Referring now to FIGS. 2, 3A and 3B, one sees that each bulb assembly 34 includes a reflector cup 60 which includes opening 61 of rectangular cross section and inclined parabolic-type walls 63 bounded by the perimeter of opening 61. Reflector cup 60 further includes a central aperture 62 at the apex of parabolic-type walls 63. Parabolic-type walls 63 are further integral with three substantially parallel bosses—two opposed snap bosses 64, 66 of a shorter length which engage apertures 68, 70, respectively, of lampbank 42 (see FIG. 2) in a snap detent arrangement and spacer boss 72 which passes through aperture 74 in lampbank 42 and engages mounting screw 73 through aperture 75 in printed circuit board 76 and maintains lampbank 42 in spaced parallel outward relationship with printed circuit board 76. When reflector cup 60 is mounted on lampbank 42, central aperture 58 on lampbank 42 aligns with respective central aperture 62 of reflector cup 60 (see FIG. 3) and bulb 78 (see FIG. 1) passes therethrough. Bulb 78 is further engaged by socket 80 which is in electrical and mechanical communication with printed circuit board 76.

The interior of reflector cup 60 serves as a reflector for bulb 78 (see FIG. 1). Lens 82 is typically of fresnel configuration and made from plastic. Lens 82 includes lower prongs 81, 83 and upper prong 85 (a second upper prong is obscured from view behind lens 82 in FIG. 2) which are shaped to hinge and snap detent engage lens 82 over the opening 61 of reflector cup 60 by engaging respective exterior corners of reflector cup 60. The upper portion of the vertical walls 84, 86 of lens 82 further includes horizontally opposed indentations 88, 90.

Louver 92, typically made by plastic injection molding and is typically at least somewhat flexible, includes an upper near-horizontal downwardly declining portion 93 which serves to shield the bulb assembly 34 and to increase the contrast of the display. Louver 92 further includes side supports 94, 95 which partially extend downwardly from the lateral edges of upper near-horizontal downwardly declining portion 93. Side supports 94, 95 include backwardly extending vertical louver prongs 96, 97 which snap detent engage horizontally opposed indentations 88, 90 of lens 82. Top louver hooks 87, 89 extend backwardly and downwardly from a rear surface of declining portion 93 so as to hookingly engage a top surface of lens 82. Central supports 98, 99, parallel to side supports 94, 95 extend downwardly from interior positions spaced intermediately between side supports 94, 95. Central supports 98, 99 help to maintain the angle of inclination of louver 92.

As backwardly extending vertical louver prongs 96, 97 of louver 92 snap detent engage horizontally opposed indentations 88, 90 of lens 82, the lens 82 and louver 92 are secured to one another and lens 82 can be removed from reflector cup 60 by a technician using louver 92 as a handle and pulling louver 92, and subsequently lens 82, away from cabinet or housing 12. This allows simple access to the bulb 78. Additionally, while not shown in the drawings, louver 92 can be designed to engage a plurality of lenses 82 thereby providing the removal of a plurality of lenses 82 by the removal of single louver 92.

Moreover, as the bulb assembly 34, comprising the reflector cup 60, lens 82 and louver 92, is in a stand-alone configuration, different character heights can be achieved by simply expanding the spacing between the bulb assemblies 34 or by making clusters of a plurality of bulb assemblies 34 to form a pixel and then varying the spacing between the resulting pixels.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A lamp assembly for displaying data comprising:

a cabinet including a front planar lampbank and a planar circuit board means spaced inwardly parallel from said front planar lampbank, said front planar lampbank including a plurality of apertures;

an array of bulb assemblies attached to said front planar portion, each of said bulb assemblies comprising:

a bulb in electrical communication with said planar circuit board means;

a reflector surrounding said bulb for reflecting light from said bulb outwardly from said lamp assembly, said reflector including a first backwardly extending boss, a second backwardly extending boss, and a third backwardly extending boss:

a lens means attached to said reflector;

a louver means attached to said lens;

said first backwardly extending boss and said second backwardly extending boss snap detent engaging first and second apertures from said plurality of apertures in said lampbank; and said third backwardly extending boss passing through third aperture from said plurality of apertures in said lampbank and attaching to said circuit board means.

2. The lamp assembly of claim 1 wherein said third backwardly extending boss is attached to said circuit board means by a mechanical fastener.

3. The lamp assembly of claim 1 wherein said reflector has an open front end and parabolic shaped rear walls, said first, second and third backwardly extending bosses being integral with said rear walls and substantially parallel with each other.

4. A lamp assembly for displaying data comprising:

a cabinet including a front planar lampbank;

an array of bulb assemblies attached to said front planar lampbank, each of said bulb assemblies comprising:

a bulb;

a reflector surrounding said bulb for reflecting light from said bulb outwardly from said lamp assembly, said reflector including a front open portion and a rear portion, said rear portion including means for attaching to said front planar lampbank;

a lens including first means for engaging said front open portion of said reflector;

a louver including second means for engaging said lens, whereby said lens can be disengaged from said reflector by a user urging said louver away from said cabinet;

wherein said first and second means for engaging comprise respective first and second means for snap detent engaging; and wherein said lens includes peripheral indentations along edges thereof and said second means for engaging said lens comprises backwardly extending prongs on said louver which snap detent engage said peripheral indentations of said lens thereby forming said second means for engaging.

5. The lamp assembly of claim 4 wherein said backwardly extending prongs are integral with lateral sides of said louver.

6. The lamp assembly of claim 5 wherein said louver includes means for maintaining inclination of said louver with respect to said lens.

7. The lamp assembly of claim 6 wherein said means for maintaining inclination of said louver with respect to said lens includes at least one portion downwardly extending from said louver positioned between said backwardly extending prongs.

* * * * *

UNITED STATES PATENT AND TRADEMARK OFFICE

CERTIFICATE OF CORRECTION

PATENT NO. : 5,704,708

DATED : Jan. 6, 1998

INVENTOR(S) : Barson et al.

It is certified that error appears in the above-indentified patent and that said Letters Patent is hereby corrected as shown below:

Title page of patent [54], also Col. 1, line 2, change "THERE" to --THREE--.

Signed and Sealed this

Twenty-eighth Day of April, 1998

Bruce Lehman

*Attest:*

BRUCE LEHMAN

*Attesting Officer*

*Commissioner of Patents and Trademarks*